US006340305B1

(12) United States Patent
Liu

(10) Patent No.: US 6,340,305 B1
(45) Date of Patent: Jan. 22, 2002

(54) CONNECTOR SOCKET

(75) Inventor: Wen-Han Liu, Taipei (TW)

(73) Assignee: Rulong Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 09/824,666

(22) Filed: Apr. 4, 2001

(51) Int. Cl.[7] ..... H01R 13/62
(52) U.S. Cl. ..... 439/159; 439/160
(58) Field of Search ..... 439/152, 153, 439/155, 159, 160

(56) References Cited

U.S. PATENT DOCUMENTS 5,368,493 A * 11/1994 O'Brien et al. ..... 439/160
6,106,313 A * 8/2000 Chen ..... 439/159
6,234,813 B1 * 5/2001 Hanyu ..... 439/159

* cited by examiner

*Primary Examiner*—Tho D. Ta
(74) *Attorney, Agent, or Firm*—Birch, Stewart, Kolasch & Birch, LLP

(57) ABSTRACT

A connector socket includes a main body having a card slot and a guide hole communicable with the card slot, a metal cover having a guide channel at one side opposite to the guide hole and a downward extended stopper opposite to the card slot, a control bar movably received in the guide channel, and a metal lever located between the metal cover and the main body and held to the metal cover with a hooking plate upwardly projecting from a hole in the metal cover. The metal lever has a first downwardly bent end engaged with an inner end of the control bar to move along with the latter, and a second downwardly bent end engaged with the guide hole on the main body. A rear edge of the metal lever has at least one supporting point in contact with the stopper of the metal cover.

8 Claims, 5 Drawing Sheets

CONNECTOR SOCKET

BACKGROUND OF THE INVENTION

The present invention relates to a connector socket, and more particularly to a connector socket that can be easily manufactured and assembled at reduced material cost and is more durable for use.

A connector socket is generally connected to a circuit board for receiving an expansion card, such as a memory card, a COMPACTFLASH card, etc. Currently, the connector socket is largely employed in computers and their related equipment.

FIG. 1 is an exploded perspective of a conventional connector socket. As shown, the conventional connect socket mainly includes a main body 1 for flatly fixing to a circuit board and having a card slot 11 for an expansion card to insert thereinto, a guide hole 12 provided at an upper outer side to communicate with the card slot 11; a metal cover 2 snapped onto the main body 1 and having a guide channel 21 facing toward a direction the same as that of the card slot 11 and a round hole 22 provided at a top thereof; a control bar 3 movably received in the guide channel 21 with an outer push end 31 projected from an outer end of the guide channel 21; and a metal lever 4 located between the metal cover 2 and the main body 1. The metal lever 4 includes a first downward bent end 41 extended into the guide channel 21 to be pushed inward by the control bar 3, and a second downward bent end 42 extended into the guide hole 12 to contact with an expansion card fully inserted into the card slot 11. The metal lever 4 is stamped to form an upward projected round hole 43 having a circular wall portion 44. The metal lever 4 is located below the metal cover 2 with the circular wall portion 44 upward extending through the round hole 22. The circular wall portion 44 is then stamped to flare and flatly associate with a top of the metal cover 2 while allowing the metal lever 4 to pivotally turn about the round hole 43 relative to the main body 1 and the metal cover 2.

The metal cover 2 permits convenient removal of the expansion card from the card slot 11. To remove the expansion card from the card slot 11, simply push the control bar 3 at the push end 31. At this point, an inner end of the control bar 3 contacts with the first bent end 41 of the metal lever 4, causing the metal lever 4 to pivotally turn about the round hole 43 and the second bent end 42 thereof to move toward and thereby push the expansion card in the card slot 11 out of the card slot 11.

The above-described conventional connector socket has the following disadvantages:

1. The metal lever 4 is stamped to form the round hole 43 and the circular wall portion 44, and the circular wall portion 44 is upward extended through the round hole 22 on the metal cover 2 and then further stamped to flatly associate with the top of the metal cover 2, such that the metal lever 4 is pivotally turnable about the round hole 43 relative to the metal cover 2. The above manufacturing procedures are complicate and require increased cost. Moreover, stamping of the circular wall portion 44 after it has been extended through the round hole 22 to assemble to the metal cover 2 is not easily controllable. And, metal powder tends to occur due to scrape of the stamped wall portion 44 against the round hole 22 and endangers the safe electric conduction provided through the connector.
2. The wall portion 44 of the round hole 43 on the metal lever 4 forms the only one center of circle around which the metal lever 4 pivotally turns, and is therefore subject to quick wearing and finally results in a disengagement of the metal lever 4 from the metal cover 2.
3. The metal cover 2 is made of a flat metal sheet of an increased thickness to ensure an overall structural strength of the cover 2. This results in increased material and difficult fabrication thereof.

It is therefore tried by the inventor to develop an improved connector socket to eliminate the drawbacks existing in the conventional connector socket.

SUMMARY OF THE INVENTION

A primary object of the present invention is to provide a connector socket that includes a metal cover having a downward and then inward bent stopper provided at a rear side of the connector socket, such that the metal cover could be made with thin material while having an enhanced overall structural strength.

Another object of the present invention is to provide a connector socket that includes a metal cover having a stopper provided at a rear side thereof, and a metal lever located below the metal cover and having at least one supporting point thereon pressing against the stopper, such that the metal lever could pivotally turn about the supporting point without causing too much frictional contact of the metal lever with the metal cover to wear both members.

A further object of the present invention is to provide a connector socket that can be easily manufactured and assembled at reduced cost.

To achieve the above and other objects, the connector socket of the present invention includes a main body having a card slot and a guide hole communicable with the card slot, a metal cover having a guide channel at one side opposite to the guide hole and a downward extended stopper opposite to the card slot, a control bar movably received in the guide channel, and a metal lever located between the metal cover and the main body and held to the metal cover with a hooking plate upward projected from a hole on the metal cover. The metal lever has a first downward bent end engaged with an inner end of the control bar to move along with the latter, and a second downward bent end engaged with the guide hole on the main body. A rear edge of the metal lever has at least one supporting point in contact with the stopper of the metal cover. When the control bar is pushed into the guide channel and the first bent end of the metal lever is moved rearward, the metal lever is pivotally turned about the supporting point and the second bent end thereof is moved forward to push a card inserted in the card slot out of the card slot.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The structure and the technical means adopted by the present invention to achieve the above and other objects can be best understood by referring to the following detailed description of the preferred embodiments and the accompanying drawings which are given by way of illustration only, and thus are not limitative of the present invention, and wherein.

DETAILED DESCRIPTION OF THE PREFERRED EMBODIMENTS

Figure 1:
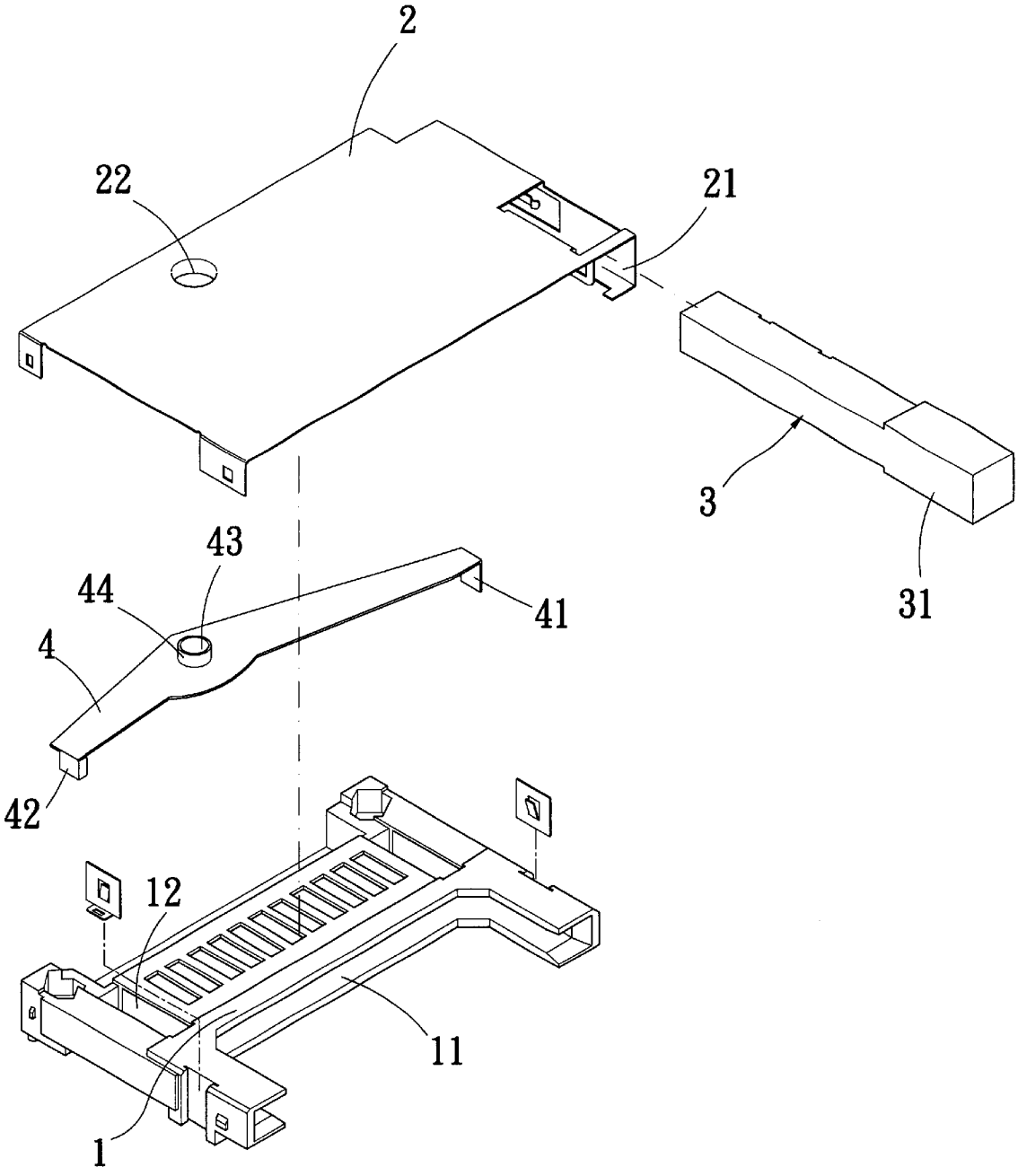
(PRIOR ART) Fig. 1
FIG. 1 is an exploded perspective of a conventional connector socket.
Figure 2:
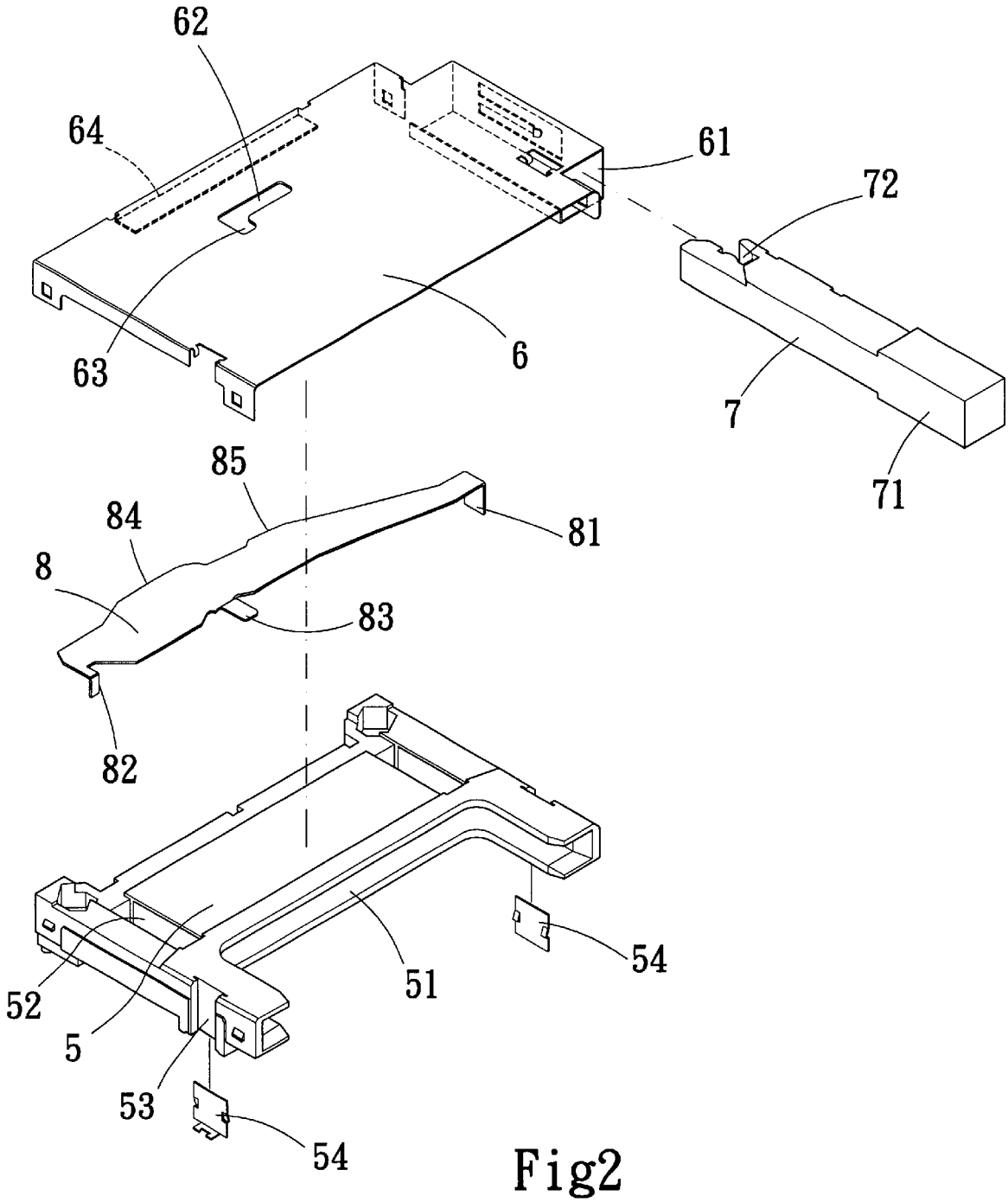
FIG. 2 is an exploded perspective of a connector socket according to the present invention.
Figure 3:
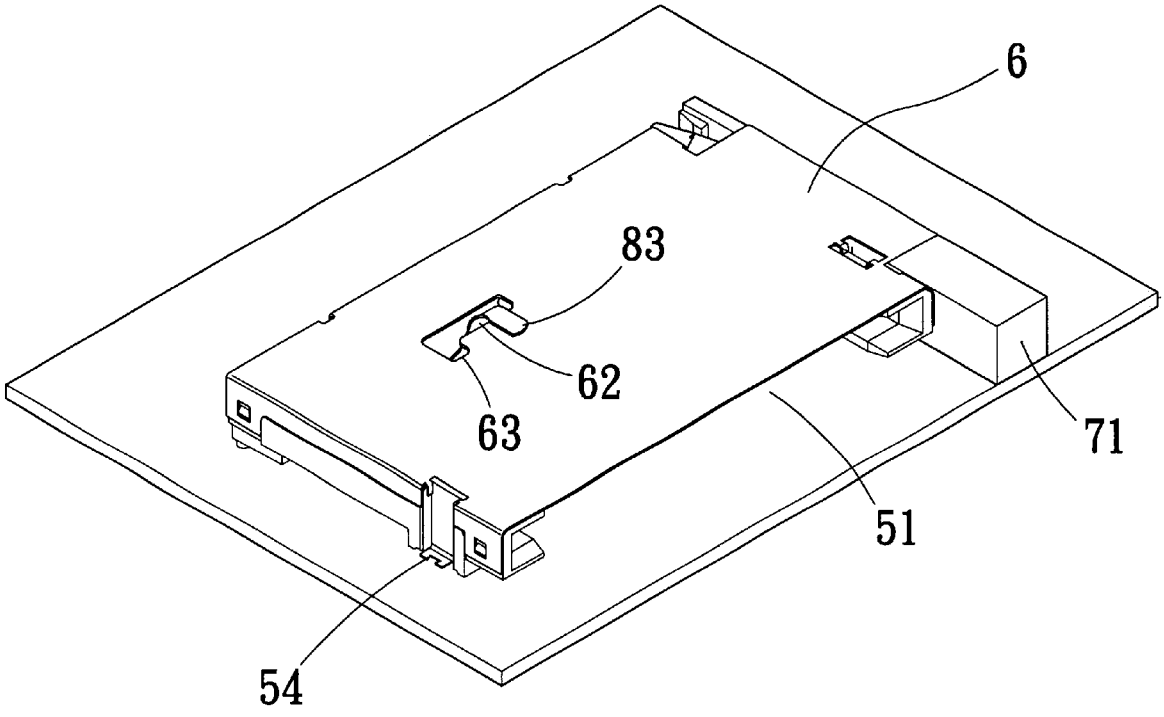
FIG. 3 is an assembled perspective of the connector socket of FIG. 2.

Please refer to FIGS. 2 and 3 that are exploded and assembled perspective views, respectively, of a connector socket according to the present invention. As shown, the connector socket mainly includes a main body 5, a metal cover 6, a control bar 7, and a metal lever 8.

The main body 5 is suitable for flatly fixing to a circuit board (not shown) and is provided at a front side with a horizontally extended card slot 51 into which, for example, an expansion card (not shown) is inserted, at one end of a top with a downward extended guide hole 52 to communicate with the card slot 51, and at each end with a recess 53 to receive a weld interface 54 therein, so that the main body 5 is welded onto the circuit board at the weld interfaces 54.

The metal cover 6 is removably connected to the top of the main body 5 and is provided at one end opposite to the guide hole 52 with a guide channel 61 that faces toward a direction the same as that of the card slot 51 for the control bar 7 to movably locate therein, at a top with an opening 62 having an expanded hole 63 formed at one end thereof, and at a rear side opposite to the card slot 51 with a length of downward and then forward bent stopper 64.

The control bar 7 is movably received in the guide channel 61 of the metal cover 6 and includes a push portion 71 at an outer end thereof and a notch 72 at an inner end thereof.

The metal lever 8 is flatly and transversely located between the metal cover 6 and the main body 5. The metal lever 8 includes a first downward bent end 81 close to the guide channel 61 of the metal cover 6 and engaged with the notch 72 of the control bar 7, a second downward bent end 82 close to and extended into the guide hole 52 of the main body 5 to contact with an expansion card inserted into the card slot 51, an upward and then forward bent hooking plate 83 projected from a front edge of the lever 8 to move into the opening 62 via the expanded hole 63 of the metal cover 6 and thereby holds the lever 8 to the metal cover 6, and a rear edge divided into an expanded first surface 84 close to the second bent end 82 and a narrowed second surface 85 close to the first bend end 81, both of the first and the second surfaces 84, 85 being detachably contacted with the stopper 64 of the metal cover 6.

Figure 4:
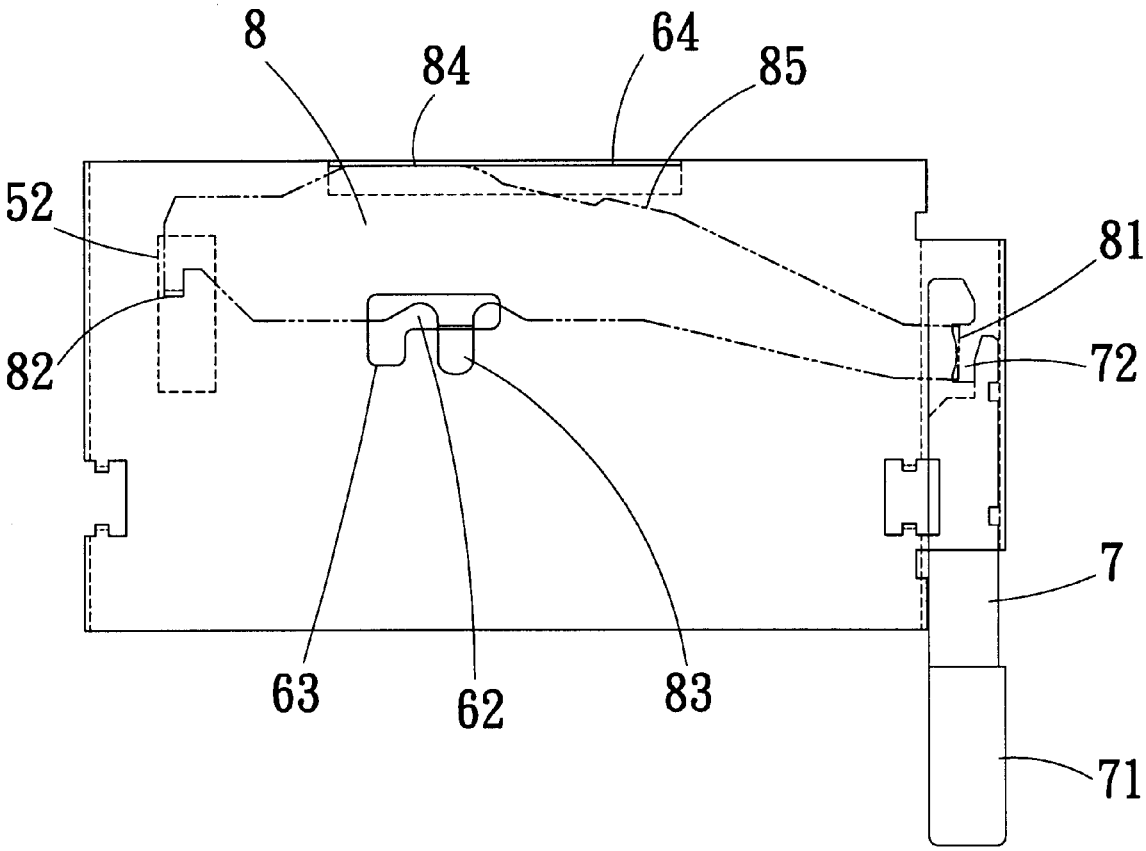
FIG. 4 is a sectioned top view of the connector socket of the present invention in a state ready for use.
Figure 5:
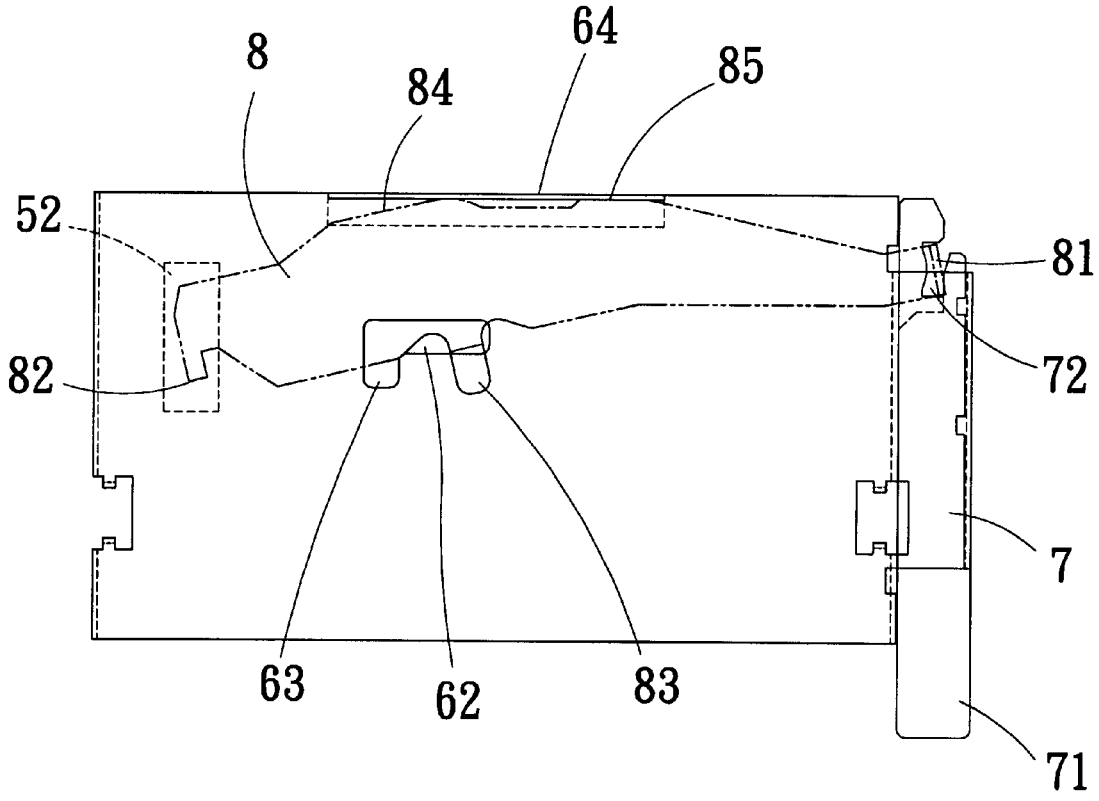
FIG. 5 is a sectioned top view of the connector socket of the present invention in a state for removing a card from the connector socket.

Please refer to FIG. 4. When an expansion card is inserted into the card slot 51 from a front side of the main body 5 of the connector socket, the second bent end 82 of the metal lever 8 is pushed by the expansion card to shift backward, bringing the first surface 84 of the rear edge of the metal lever 8 to contact with the stopper 64 at the rear side of the metal cover 6. At this point, the first surface 84 serves as a supporting point, and the metal lever 8 is pivotally turned about the first surface 84 to move the first bent end 81 forward and thereby push the control bar 7 outward relative to the guide channel 61. On the other hand, when an extension card is to be removed from the card slot 51, simply push the control bar 7 at the push portion 71, as shown in FIG. 5, so that the first bent end 81 of the metal lever 8 in the notch 72 of the control bar 7 is moved rearward and brings the second surface 85 of the metal lever 8 to contact with the stopper 64 of the metal cover 6. At this point, the second surface 85 serves as a supporting point and the metal lever 8 is pivotally turned about the second surface 85 to move the second bent end 82 forward and thereby push the expansion card out of the card slot 51.

The notch 72 provided at the inner end of the control bar 7 serves as a means to prevent the first bend end 81 of the metal lever 8 from lateral displacement. The hooking plate 83 is so located at the metal lever 8 that it is extended through the opening 62 to abut on a front edge of the opening 62 without being easily detachable therefrom.

The following are some of the advantages that make the connector socket of the present invention superior to the conventional connector socket:

1. The metal lever 8 pivotally turns with the first or the second surfaces 84, 85 as a supporting point, depending on an actual moving direction of the first and the second bent end 81, 82. With two supporting points that work alternately, the metal lever 8 is less liable to wear at a certain fixed point. And, a design based on the leverage prevents the metal lever 8 from easy separation from the metal cover due to a force applied on the lever 8.
2. The metal cover 6 and the metal lever 8 are easy to produce and assemble, enabling a reduced manufacturing cost and a smooth operation of the metal lever 8 relative to the metal cover 6.
3. The downward and then forward bent stopper 64 of the metal cover 6 also helps in enhancing an overall structural strength of the metal cover 6. Thus, the metal cover 6 could be made with a metal sheet of reduced thickness to enable a lowered material cost and easy fabrication without adversely affecting the strength of the cover 6 and the stopper 64.

It is appreciated that the metal lever 8 of the present invention is not necessarily to have the first and the second surface 84, 85 provided at the rear edge thereof.

The metal lever 8 may also be designed to have a rear edge that includes a rearward protruded portion corresponding to the hooking plate 83 at the front edge of the lever 8 and two forward and outward inclined portions at two sides of the rearward protruded portion. For example, the rear edge of the metal lever 8 may be an outward curved edge with the hooking plate 83 as a center of circle thereof.

The present invention has been described with a preferred embodiment thereof and it is understood that many changes and modifications in the described embodiment can be carried out without departing from the scope and the spirit of the invention that is intended to be limited only by the appended claims.

What is claimed is:

1. A connector socket, comprising a main body, a cover, a control bar, and a lever member;

said main body being flatly fixed to a circuit board and being provided at a front side with a horizontally extended card slot, and at one end of a top with a guide hole communicable with said card slot;

said cover being removably connected to the top of said main body and being provided at an end opposite to said guide hole of said main body with a guide channel, at a rear side opposite to said card slot of said main body with a downward and then forward bent stopper, and at a predetermined position of a top with an opening;

said control bar being movably received in said guide channel of said cover; and said lever member being flatly and transversely located between said cover and said main body and movably held to said cover by a hooking plate provided at a front edge of said lever member to upward project from and abut on said opening on said cover, said lever member including a first downward bent end close to said guide channel of said cover and engaged with an inner end of said control bar to move along with said control bar, and a second downward bent end close to and extended into said guide hole of said main body, said lever member having a rear edge that is so formed that at least one point thereof is in contact with said stopper of said cover to serve as a supporting point for said lever member to pivotally turn about said supporting point relative to said stopper;

whereby when said control bar is pushed inward relative to said guide channel, said first bent end of said lever member engaged with said control bar is moved rearward for said at least one supporting point on said rear edge of said lever member to contact with said stopper of said cover and cause said lever member to pivotally turn about said at least one supporting point, bringing said second bent end of said lever member to move forward and push a card in said card slot out of said card slot;

said control bar being provided at said inner end with a notch into which said first bent end of said lever member is engaged to prevent said lever member from undesired lateral displacement.

2. The connector socket as claimed in claim 1, wherein the cover and lever member are metal.

3. The connector socket as claimed in claim 1, wherein said rear edge of said lever member is provided with at least one rearward protruded surface, and with two forward and outward inclined portions.

4. The connector socket as claimed in claim 3, wherein said at least one rearward protruded portion of said rear edge of said lever member is a curved edge with said hooking plate being a center of a circle passing through the curved edge.

5. A connector socket, comprising a main body, a cover, a control bar, and a lever member;

said main body being flatly fixed to a circuit board and being provided at a front side with a horizontally extended card slot, and at one end of a top with a guide hole communicable with said card slot;

said cover being removably connected to the top of said main body and being provided at an end opposite to said guide hole of said main body with a guide channel, at a rear side opposite to said card slot of said main body with a downward and then forward bent stopper, and at a predetermined position of a top with an opening;

said control bar being movably received in said guide channel of said cover; and said lever member being flatly and transversely located between said cover and said main body and movably held to said cover by a hooking plate provided at a front edge of said lever member to upward project from and abut on said opening on said cover, said lever member including a first downward bent end close to said guide channel of said cover and engaged with an inner end of said control bar to move along with said control bar, and a second downward bent end close to and extended into said guide hole of said main body, said lever member having a rear edge that is so formed that at least one point thereof is in contact with said stopper of said cover to serve as a supporting point for said lever member to pivotally turn about said supporting point relative to said stopper;

whereby when said control bar is pushed inward relative to said guide channel, said first bent end of said lever member engaged with said control bar is moved rearward for said at least one supporting point on said rear edge of said lever member to contact with said stopper of said cover and cause said lever member to pivotally turn about said at least one supporting point, bringing said second bent end of said lever member to move forward and push a card in said card slot out of said card slot;

wherein said hooking plate of said lever member is upward and then forward bent to project from said opening on said cover.

6. The connector socket as claimed in claim 5, wherein the cover and lever member are metal.

7. The connector socket as claimed in claim 5, wherein said rear edge of said lever member is provided with at least one rearward protruded surface, and with two forward and outward inclined portions.

8. The connector socket as claimed in claim 7, wherein said at least one rearward protruded portion of said rear edge of said lever member is a curved edge with said hooking plate being a center of a circle passing through the curved edge.

* * * * *